United States Patent [19]

Kranich

[11] 3,986,756

[45] Oct. 19, 1976

[54] STORAGE BIN AND DISPLAY ASSEMBLY FOR ROLLS OF DECORATIVE PAPER AND THE LIKE

[76] Inventor: Joel H. Kranich, 1 Parkton Place, Pittsburgh, Pa. 15232

[22] Filed: Feb. 21, 1975

[21] Appl. No.: 551,925

[52] U.S. Cl. ..... 312/117; 206/44.11; 206/45; 312/198; 312/234.1; 312/278

[51] Int. Cl.[2] ..... A47B 53/00; A47F 3/00; A47F 7/16; A47F 7/17

[58] Field of Search ..... 206/44 R, 44.11, 45; 108/60; 312/117, 126, 128, 234, 198, 278, 295, 118

[56] References Cited

UNITED STATES PATENTS

| | | | |
|---|---|---|---|
| 1,325,238 | 12/1919 | Flannery | 312/117 |
| 1,563,148 | 11/1925 | Bartol et al. | 206/44.11 |
| 1,739,730 | 12/1929 | Orthwine | 312/117 X |
| 2,547,368 | 4/1951 | Booth | 312/198 |
| 2,788,827 | 4/1957 | Banner | 206/45 UX |
| 3,567,302 | 3/1971 | Carlson | 312/198 X |
| 3,737,046 | 6/1973 | Jeter | 108/60 X |

FOREIGN PATENTS OR APPLICATIONS

| | | | |
|---|---|---|---|
| 419,225 | 11/1934 | United Kingdom | 312/117 |

*Primary Examiner*—Paul R. Gilliam
*Assistant Examiner*—Carl F. Pietruszka
*Attorney, Agent, or Firm*—Brown, Murray, Flick & Peckham

[57] ABSTRACT

A combined storage bin and display assembly for rolls of decorative paper, such as wallpaper, wherein a plurality of parallel upstanding partitions are arranged along an essentially straight-line path with each of the partitions being disposed at an angle with respect to the straight-line path. Shelves span the space between successive ones of the partitions to form vertically-spaced bins for the storage of rolls of decorative paper, the shelves terminating before a forward edge of an associated one of each of the partitions whereby a display area is formed for each bin between the termination of its shelf and the forward edge of an associated partition. In this manner, a sample of the decorative paper stored in a bin can be displayed on a display area in front of the bin, all of the display areas being readily visible to a shopper as he walks along the forward edges of the storage bins.

4 Claims, 2 Drawing Figures

STORAGE BIN AND DISPLAY ASSEMBLY FOR ROLLS OF DECORATIVE PAPER AND THE LIKE

BACKGROUND OF THE INVENTION

As is known, decorative paper, such as wallpaper, is ordinarily sold with the use of sample books. The customer must thumb through the sample books until an appealing wallpaper design is reached. It is then necessary for a salesperson to take an identifying number from the sample of wallpaper in the display book and locate in inventory the corresponding rolls of wallpaper.

Recently, attention has been given to merchandizing wallpaper on a serve-yourself basis in much the same manner as a food supermarket. That is, the concept is to permit the customer to browse around a store and pick rolls of wallpaper or other decorative material directly from bins. A problem arises, however, as to how to display samples of the various wallpapers within the bins without the necessity for sample books.

SUMMARY OF THE INVENTION

In accordance with the present invention, a combined storage bin and display assembly is provided for rolls of decorative paper and the like wherein the rolls of decorative paper are stored in vertically stacked bins provided with display areas adjacent the end of a bin. This is accomplished in a manner which provides an excellent display of the wallpaper samples, permits easy access to the rolls of paper within the bins, and at the same time minimizes the amount of store floor space required.

Figure 1:
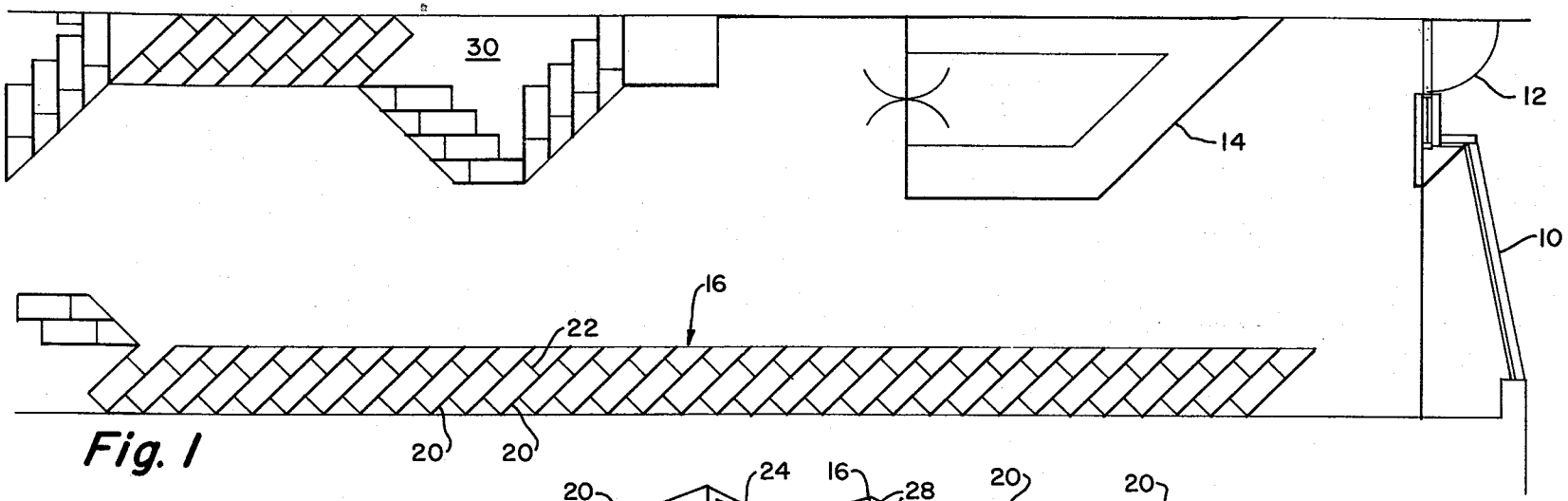
Figure 2:
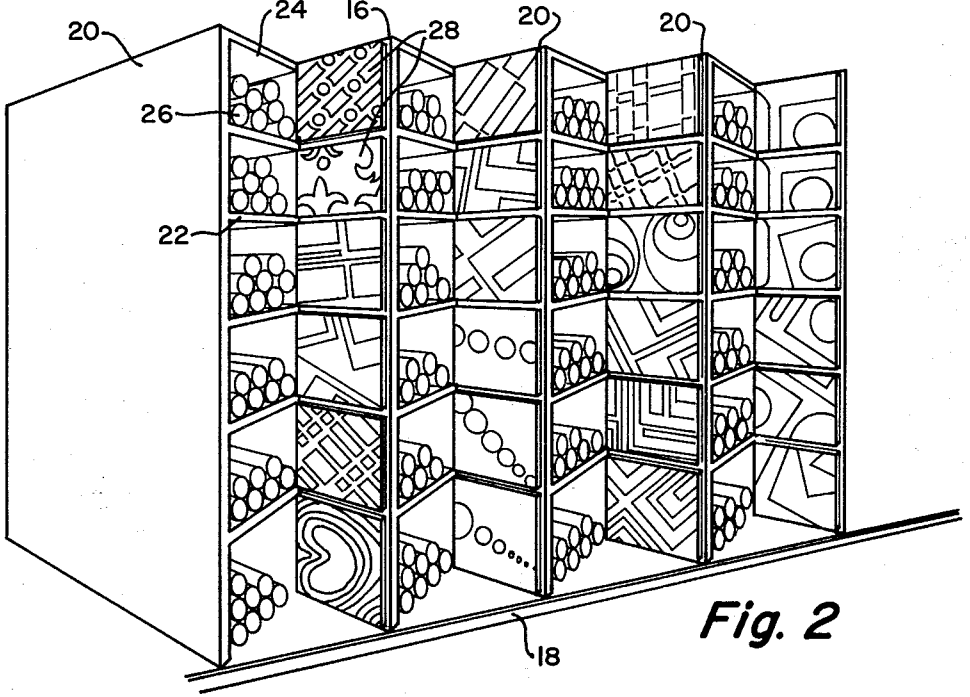

The above and other objects and features of the invention will become apparent from the following detailed description taken in connection with the accompanying drawings which form a part of this specification, and in which:

FIG. 1 is a plan or top view of a store incorporating the combined storage bin and display assemblies of the invention; and FIG. 2 is a perspective view of the combined storage bin and display assemblies of the invention.

With reference now to FIG. 1, there is shown a plan view of a typical storeroom having a plate glass front window 10 and a front door 12. Within the storeroom itself is a service counter 14 where customers pay for their purchases and have them wrapped. The novel storage bin and display assemblies of the invention are disposed along the two side walls of the store and are identified generally by the reference numeral 16.

With reference to FIG. 2, the storage bin and display assemblies are mounted on a raised platform 18. They comprise spaced, vertically-extending side partitions 20 (see also FIG. 1) which are all disposed at an angle with respect to the straight-line path of travel of the platform 18. Spanning the space between each adjacent pair of parallel partitions 20 are shelves 22 which form bins 24 for rolls 26 of decorative paper stored therein. As is perhaps best shown in FIG. 1, each of the shelves 22 has forward and rear edges which are perpendicular to two bounding partitions 20. The forward edge of each shelf, however, does not extend beyond the forward edge of one of the two bounding partitions so as to provide on the other bounding partition a display area 28 in front of each bin and disposed forwardly thereof at an angle with respect to the front edge of the platform 18. On each display area 28 is a sample of the decorative paper stored in its associated bin. These samples can be secured to the display areas by glue or can be inserted into slots. Thus, a customer may simply walk along the storage racks and view the samples on display areas 28. If he sees a sample he likes, he will then simply pick one or more rolls of paper from an associated bin 26, go to the service desk 14 and pay for it. The necessity for having display books and sales-persons who must hunt for and remove rolls of paper from inventory are entirely eliminated. The bins may extend along an entire wall as shown in FIG. 1 or may be arranged in groups as at 30 in order to provide a set of display surfaces and bins which project outwardly toward the center of the store.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A combined storage bin and display assembly for rolls of decorative paper and the like comprising:

a. a plurality of parallel upstanding partitions arranged along an essentially straight-line path with each of said partitions being disposed at an angle with respect to said straight-line path, b. a plurality of vertically-spaced shelves spanning the space between said partitions to form rows of vertically-spaced bins with open ends for the storage of rolls of decorative paper, each of said shelves terminating before a forward edge of an associated one of said partitions whereby a display area is formed by said partitions for each bin between the termination of its shelf and the forward edge of said associated partition, said display area receiving a sample of the decorative paper stored in an adjacent bin, and c. support means on which said upstanding partitions are supported.

2. The combined storage bin and display assembly of claim 1 wherein said support means includes a platform.

3. The combined storage bin and display assembly of claim 1 wherein said support means includes a raised platform extending along said straight-line path while supporting said partitions at an angle with respect to the path.

4. The combined storage bin and display assembly of claim 1 wherein the forward and rearward edges of said shelves are perpendicular to two bounding partitions.

* * * * *